United States Patent [19]

Stoltman

[11] 4,399,798

[45] Aug. 23, 1983

[54] EXHAUST GAS RECIRCULATION CONTROL

[75] Inventor: Donald D. Stoltman, Henrietta, N.Y.

[73] Assignee: General Motors Corporation, Detroit, Mich.

[21] Appl. No.: 339,119

[22] Filed: Jan. 13, 1982

[51] Int. Cl.[3] ..... F02M 25/06

[52] U.S. Cl. ..... 123/571; 123/568

[58] Field of Search ..... 123/568, 571, 569

[56] References Cited

U.S. PATENT DOCUMENTS

| | | | |
|---|---|---|---|
| 4,128,090 | 12/1978 | Aoyama | 123/568 |
| 4,137,874 | 2/1979 | Otsubo et al. | 123/568 |
| 4,148,286 | 4/1979 | Kohama et al. | 123/568 |
| 4,149,500 | 4/1979 | Aoyama | 123/568 |
| 4,164,918 | 8/1979 | Haka | 123/571 |
| 4,177,777 | 12/1979 | Maruyama et al. | 123/571 |
| 4,180,034 | 12/1979 | Vogelsberg | 123/568 |
| 4,186,698 | 2/1980 | Aoyama | 123/568 |
| 4,196,707 | 4/1980 | Stoltman | 123/571 |
| 4,210,112 | 7/1980 | Nakamura et al. | 123/571 |
| 4,245,606 | 1/1981 | Okamura | 123/568 |

*Primary Examiner*—Wendell E. Burns

*Attorney, Agent, or Firm*—C. K. Veenstra

[57] ABSTRACT

In an internal combustion engine, recirculation of exhaust gases is controlled to maintain the control pressure in a zone of the recirculation passage proportional to a reference pressure and thus to provide exhaust gas recirculation as a proportion of induction air flow. A duty cycle modulated valve controls an exhaust back-pressure port and an atmospheric pressure port to create the reference pressure, whereby the proportion of exhaust gases recirculated is established by the duty cycle and is independent of the induction air flow.

10 Claims, 1 Drawing Figure

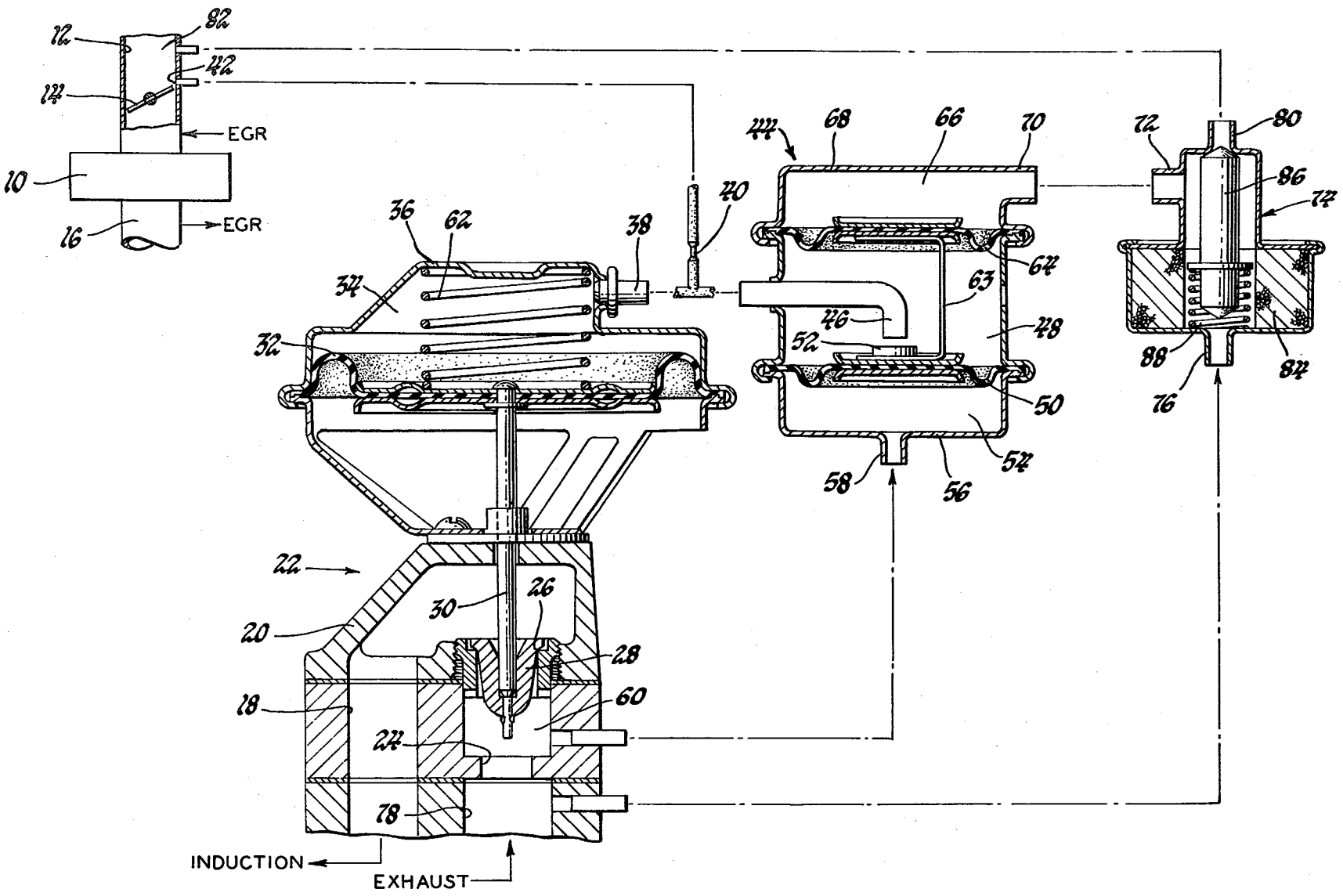
EGR
EGR
EXHAUST
INDUCTION

EXHAUST GAS RECIRCULATION CONTROL

TECHNICAL FIELD

This invention relates to control of exhaust gas recirculation and provides a novel assembly and method for controlling exhaust gas recirculation in proportion to induction air flow and for changing the proportion for selected operating conditions.

BACKGROUND

Recirculation of exhaust gases has been developed as a method for inhibiting formation and emission of oxides of nitrogen during the combustion process in an automotive engine. In general, it is desired to recirculate exhaust gases at a rate proportional to the rate of induction air flow. To accomplish that purpose, exhaust gas recirculation (EGR) control assemblies have included a valve pintle positioned to maintain the control pressure in the EGR passage upstream of the pintle equal to a reference pressure. Recirculation of exhaust gases has thus been varied with exhaust backpressure, which in turn varies with induction air flow, to provide exhaust gas recirculation substantially proportional to induction air flow.

In such prior EGR control assemblies, the pintle was positioned in accordance with a subatmospheric operating pressure that was regulated by a transducer. The transducer employed an air bleed valve to regulate the operating pressure; the bleed valve was carried on a control diaphragm subjected on one side to the control pressure in the EGR passage and balanced by atmospheric pressure on the opposite side and by the bias of a spring or other force producing member; the combination of atmospheric pressure and the spring or other bias formed the reference pressure. With such an assembly, when the induction air flow (and thus the engine exhaust backpressure) decreased and the control pressure accordingly started to fall below the reference pressure, the air bleed was opened to increase the operating pressure and cause the pintle to reduce exhaust gas recirculation; when the induction air flow (and thus the engine exhaust backpressure) increased and the control pressure accordingly started to rise above the reference pressure, the air bleed was closed to reduce the operating pressure and cause the control valve pintle to increase exhaust gas recirculation. The transducer thus varied the operating pressure so the pintle was positioned to maintain the control pressure equal to the reference pressure and thereby provide EGR as a proportion of induction air flow.

In some applications it may be desirable not only to provide exhaust gas recirculation as a proportion of induction air flow, but also to vary the proportion from one set of engine operating conditions to another. For example, during heavy load operation it may be desired to recirculate exhaust gases in a relatively high proportion to induction air flow, while during light load operation it may be desired to recirculate exhaust gases in relatively low proportion to induction air flow. Some proposals for changing the proportion involved use of a third valve element to adjust the area of the EGR passage upstream of the control valve pintle—with all the complexities attendant upon use of a third valve element. Other proposals for changing the proportion involved changing the reference pressure to establish a new control pressure; however, when the control pressure is changed to a value which differs from atmospheric pressure, the proportion of exhaust gases recirculated is no longer exactly constant but instead varies slightly with induction air flow.

SUMMARY

This invention provides a novel assembly and method for controlling exhaust gas recirculation in proportion to induction air flow in a manner which allows the proportion to remain constant as induction air flow varies and yet which allows the proportion to be changed under selected engine operating conditions.

With this invention, the reference pressure is created in a manner which allows it to vary as a direct proportion of exhaust backpressure; the reference pressure increases an exhaust backpressure increases, and the reference pressure decreases as exhaust backpressure decreases. Now as recirculation of exhaust gases is controlled to maintain the control pressure equal (or at least proportional) to the reference pressure, exhaust gas recirculation will be a constant proportion of induction air flow.

Further, with this invention the proportion of exhaust gas recirculation to induction air flow may be varied by changing the proportion between the reference pressure and exhaust backpressure—increasing the reference pressure as a proportion of exhaust backpressure to reduce the proportion of exhaust gas recirculation to induction air flow, and reducing the reference pressure as a proportion of exhaust backpressure to increase the proportion of exhaust gas recirculation to induction air flow. In the preferred embodiment of this invention set forth herein, a duty cycle modulated valve is employed to create the reference pressure by combining exhaust backpressure and atmospheric pressure signals. When this valve is not energized (0% duty cycle), the reference pressure is equal to exhaust backpressure, the control pressure is accordingly maintained equal to exhaust backpressure, and no exhaust gases are recirculated through the control pressure zone. As the valve is energized with an intermediate duty cycle, a reference pressure is created intermediate exhaust backpressure and atmospheric pressure, the control pressure is maintained equal to the lower reference pressure, and exhaust gases are recirculated in constant proportion to induction air flow with the proportion being established by the duty cycle. When the valve is continuously energized (100% duty cycle), the reference pressure is equal to atmospheric pressure, the control pressure is maintained equal to atmospheric pressure, and exhaust gases are recirculated in constant proportion to induction air flow with the proportion being limited only by the relative restrictions of the recirculation and exhaust passages.

The details as well as other features and advantages of this invention are set forth in the remainder of the specification and are shown in the accompanying drawing.

SUMMARY OF THE DRAWING

The sole FIGURE of the drawing is a schematic view of an exhaust gas recirculation control system employing a preferred embodiment of this invention.

BEST MODE FOR CARRYING OUT THE INVENTION

Referring to the drawing, an internal combustion engine 10 has a passage 12 for induction air flow to the engine, a throttle 14 controlling induction air flow through passage 12, and an exhaust passage 16. An exhaust gas recirculation (EGR) passage 18 extends from exhaust passage 16 through the body 20 of an EGR control unit 22 and then to induction passage 12 downstream of throttle 14.

An orifice 24 is formed in EGR passage 18 upstream of a valve seat 26. A control valve pintle 28 is associated with valve seat 26 and has a stem 30 extending to an operating diaphragm 32. Diaphragm 32 defines a portion of an operating pressure chamber 34 closed by a cover 36.

Cover 36 has a fitting 38 which senses, through a restriction 40, the pressure signal created at a port 42 in induction passage 12 adjacent the edge of throttle 14. Fitting 38 senses the subatmospheric induction passage pressure downstream of throttle 14 during open throttle operation and the substantially atmospheric pressure upstream of throttle 14 during idle and other closed throttle modes of operation.

A transducer 44 has an air bleed port 46 opening to fitting 38 from a chamber 48 exposed to air at atmospheric pressure. Transducer 44 includes a control diaphragm 50 which carries a bleed valve 52 to control flow through air bleed 46. Control diaphragm 50 forms a portion of a control pressure chamber 54 closed by a cover 56. Cover 56 has a fitting 58 for sensing the control pressure created in the control pressure zone 60 of EGR passage 18 between orifice 24 and valve seat 26.

The construction described thus far is conventional. During operation, a decrease in the control pressure in zone 60 is sensed in control pressure chamber 54, and control diaphgram 50 is lowered by the opposing reference pressure on diaphragm 50, moving bleed valve 52 away from air bleed 46 to permit air flow into chamber 34. The increased operating pressure in chamber 34 then allows a spring 62 to lower operating diaphragm 32 and control valve pintle 28 toward valve seat 26. The resulting decrease in the exhaust gas recirculation area between control valve pintle 28 and valve seat 26 reduces exhaust gas recirculation, and the control pressure in zone 60 increases to balance the pressure in control pressure chamber 54 with the reference pressure.

Upon an increase in the control pressure in zone 60, control diaphragm 50 lifts bleed valve 52 to obstruct air flow through bleed 46. The operating pressure in chamber 34 is then reduced by the subatmospheric pressure signal at port 42, and operating diaphragm 32 is raised against the bias of spring 62 to lift control valve pintle 28 from valve seat 26. The resulting increase in the exhaust gas recirculation area provides increased exhaust gas recirculation, and the control pressure in zone 60 drops to balance the pressure in control pressure chamber 54 with the reference pressure.

EGR control unit 22 thus positions valve pintle 28 to provide exhaust gas recirculation at rates which maintain the control pressure in zone 60 and chamber 54 equal to the reference pressure.

When the control pressure in zone 60 equals the reference pressure, the flow of exhaust gases into zone 60 varies as a function of the exhaust backpressure in passage 16. Since the exhaust backpressure is a function of the flow through engine 10—that is, a function of the exhaust gas flow through passage 16 and thus the induction air flow through passage 12—exhaust gas recirculation through EGR passage 18 will be proportional to induction air flow through passage 12.

Within transducer 44, a bracket 63 interconnects control diaphragm 50 with a reference diaphragm 64. As shown here, diaphragms 50 and 64 are the same size, and atmospheric pressure in chamber 48 therefore exerts equal and oppositely directed forces on diaphragms 50 and 64; accordingly, atmopsheric pressure in chamber 48 does not contribute to the reference pressure on diaphragm 50. It will be appreciated, however, that diaphragms 50 and 64 could be selected to have different effective areas.

Reference diaphragm 64 forms a portion of a reference pressure chamber 66 closed by a cover 68. Cover 68 has a fitting 70 connected to a fitting 72 of a pulse width modulated valve unit 74. Valve unit 74 also has a port or fitting 76 connected to the backpressure zone 78 of EGR passage 18 upstream of orifice 24. In addition, valve unit 74 has a port or fitting 80 connected to an atmospheric pressure region 82 of induction passage 12; it will be appreciated, however, that fitting 80 could alternatively be connected to a region of either superatmospheric pressure or subatmospheric pressure, although preferably such a region would be of substantially constant pressure.

Within valve unit 74, energization of a coil 84 moves a valve element 86 against the bias of a spring 88 to open fitting 80 and close fitting 76; deenergization of coil 84 allows spring 88 to move valve element 86 to open fitting 76 and close fitting 80 as shown. Preferably coil 84 is energized according to a pulse width or other duty cycle modulated schedule so that valve element 86 applies atmospheric pressure from fitting 80 through fittings 72 and 70 to reference pressure chamber 66 during a portion of the schedule and applies exhaust backpressure from fitting 76 through fittings 72 and 70 to reference pressure chamber 66 during the remainder of the schedule. Valve unit 74 thereby creates a reference pressure which varies with the duty cycle between atmospheric pressure and exhaust backpressure. As the duty cycle increases, the reference pressure drops toward the atmospheric pressure available in fitting 80, and as the duty cycle decreases, the reference pressure climbs toward the exhaust backpressure available in fitting 76.

It also will be appreciated that, at a constant duty cycle, the reference pressure will vary with exhaust backpressure, increasing and decreasing in direct proportion with the exhaust backpressure.

The reference pressure is applied to the upper or reference pressure chamber face of diaphragm 64 and opposes the control pressure applied to the lower or control pressure chamber face of diaphragm 50. Upon an increase in the reference pressure, diaphragm 64, bracket 63 and diaphragm 50 move downwardly, displacing bleed valve 52 from air bleed 46 to increase the operating pressure in chamber 34; spring 62 then displaces pintle 28 toward seat 26 to reduce recirculation of exhaust gases and cause the control pressure in zone 60 and chamber 54 to balance the increased reference pressure. Upon a decrease in the reference pressure, diaphragm 50, bracket 63 and diaphragm 64 move upwardly, engaging bleed valve 52 with air bleed 46 and allowing subatmospheric pressure from port 42 to decrease the operating pressure in chamber 34; diaphragm 32 then lifts pintle 28 from valve seat 26 to increase recirculation of exhaust gases and cause the control pressure in zone 60 and chamber 54 to balance the reduced reference pressure.

Upon an increase in induction air flow, the exhaust backpressure in zone 78 and fitting 76 will increase, the reference pressure in chamber 66 will increase a proportional amount, and pintle 28 will be repositioned to allow the recirculation that will balance the control pressure in zone 60 and chamber 54 with the increased reference pressure. Although both the exhaust backpressure in zone 78 and the control pressure in zone 60 increase in this instance, the control pressure increase is only a proportion of the exhaust backpressure increase (as determined by duty cycle modulated valve unit 74), and the corresponding increase in the pressure differential across orifice 24 results in an increase in exhaust gas recirculation. Similarly, upon a decrease in induction air flow, the exhaust backpressure will decrease, the reference pressure in chamber 66 will decrease a corresponding amount, and pintle 28 will be repositioned to allow the recirculation that will balance the control pressure in zone 60 and chamber 54 with the decreased reference pressure. The corresponding decrease in the pressure differential across orifice 24 will result in a decrease in exhaust gas recirculation.

From the foregoing it will be understood that, at a constant duty cycle, the pressure differential across orifice 24 and the resulting exhaust gas recirculation are functions solely of exhaust backpressure. Since exhaust backpressure is similarly a function of induction air flow, exhaust gas recirculation is a constant proportion of induction air flow.

Upon a change in engine operating conditions requiring an increase in the proportion of exhaust gases recirculated, the duty cycle of valve unit 74 will be increased by appropriate means to reduce the reference pressure. Pintle 28 will then be displaced from seat 26 to allow the increased recirculation that will balance the control pressure in zone 60 and chamber 54 with the reduced reference pressure in chamber 66. At 100% duty cycle (when coil 84 of valve unit 74 is continuously energized), the reference pressure in chamber 66 will equal the atmospheric pressure in fitting 80, maximizing the proportion of exhaust gases recirculated. Similarly, upon a change in engine operating conditions requiring a decrease in the proportion of exhaust gases recirculated, the duty cycle of valve unit 74 will be decreased to increase the reference pressure. Pintle 28 will then be displaced toward seat 26 to decrease recirculation and balance the control pressure in zone 60 and chamber 54 with the increased reference pressure in chamber 66. At 0% duty cycle (when coil 84 of valve unit 74 is continuously (deenergized), the reference pressure in chamber 66 will equal the exhaust backpressure in zone 78, and pintle 28 will be seated to preclude exhaust gas recirculation.

The operating pressure in chamber 34 is at times dependent upon the subatmospheric induction passage pressure signal received from port 42. During closed throttle operation, port 42 senses the substantially atmospheric pressure upstream of throttle 14, and spring 62 engages pintle 28 with its seat 26 to interrupt exhaust gas recirculation. During wide open throttle operation, the pressure in induction passage 12 downstream of throttle 14 approaches atmospheric pressure, and spring 62 again engages pintle 28 with its seat 26 to interrupt exhaust gas recirculation. During a range of part throttle operation, however, variations in the induction passage pressure downstream of throttle 14 do not affect exhaust gas recirculation—for if the operating pressure in chamber 34 causes operating diaphragm 32 to move pintle 28 from that position which provides exhaust gas recirculation maintaining the control pressure in zone 60 and chamber 54 equal to the reference pressure, transducer 44 will restore the operating pressure in chamber 34 to the level necessary to return pintle 28 to that position.

It will be appreciated that a spring may be included in transducer 44 to include a bias in the reference pressure.

As noted above, valve unit 74 is effective to vary the reference pressure between the atmospheric pressure available at fitting 80 and the exhaust backpressure available at fitting 76. For any selected duty cycle, valve unit 74 provides a time averaged modulation of fittings 76 and 80 to create a reference pressure which could also be created—without valve element 86—by appropriate restrictions in fittings 76 and 80. However, the use of a duty cycle modulated valve provides the ability to schedule the proportion of exhaust gases recirculated for various engine operating conditions. Moreover, it should be recognized that non-duty cycle modulated valve mechanisms could be employed to modulate fittings 76 and 80 in applications where such are appropriate.

The embodiments of the invention in which an exclusive property or privilege is claimed are defined as follows:

1. An exhaust gas recirculation control assembly for an engine having an induction passage for induction air flow and a recirculation passage for exhaust gas recirculation to said induction passage, said assembly comprising an orifice dividing said recirculation passage into a control pressure zone and a backpressure zone upstream of said control pressure zone, means for creating a reference pressure directly proportional to the backpressure in said backpressure zone, a control valve in said recirculation passage, and means for operating said control valve to provide exhaust gas recirculation at rates which maintain the pressure in said control pressure zone proportional to said reference pressure, whereby exhaust gas recirculation is provided as a proportion of induction air flow with said proportion being independent of induction air flow.

2. An exhaust gas recirculation control assembly for an engine having an induction passage for induction air flow and a recirculation passage for exhaust gas recirculation to said induction passage, said assembly comprising an orifice dividing said recirculation passage into a control pressure zone and a backpressure zone upstream of said control pressure zone, means defining a reference pressure chamber having ports opening to said backpressure zone and to another zone, means controlling flow through at least one of said ports to create a reference pressure in said chamber, a control valve in said recirculation passage, and means for operating said control valve to provide exhaust gas recirculation at rates which maintain the pressure in said control pressure zone proportional to said reference pressure, whereby exhaust gas recirculation is provided as a proportion of induction air flow with said proportion being established by said ports.

3. An exhaust gas recirculation control assembly for an engine having an induction passage for induction air flow and a recirculation passage for exhaust gas recirculation to said induction passage, said assembly comprising an orifice dividing said recirculation passage into a control pressure zone and a backpressure zone upstream of said control pressure zone, means defining a reference pressure chamber, a duty cycle operated valve for connecting said chamber to said backpressure zone during a portion of the duty cycle and to another zone during the remainder of the duty cycle to create a reference pressure in said chamber, a control valve in said recirculation passage, and means for operating said control valve to provide exhaust gas recirculation at rates which maintain the pressure in said control pressure zone proportional to said reference pressure, whereby exhaust gas recirculation is provided as a proportion of induction air flow with said proportion being established by the duty cycle.

4. An exhaust gas recirculation control assembly for an engine having an induction passage for induction air flow and a recirculation passage for exhaust gas recirculation to said induction passage, said assembly comprising an orifice dividing said recirculation passage into a control pressure zone and a backpressure zone upstream of said control pressure zone, means defining a reference pressure chamber having a port opening to said backpressure zone and another port opening to another zone, a valve for modulating at least one of said ports to create a reference pressure in said chamber, a valve for regulating an operating pressure in response to a deviation of the pressure in said control pressure zone from a selected proportion of said reference pressure, and a control valve in said recirculation passage positioned in accordance with said operating pressure to provide exhaust gas recirculation at rates which maintain the pressure in said control pressure zone proportional to said reference pressure, whereby exhaust gas recirculation is provided as a proportion of induction air flow with said proportion being established by said modulating valve.

5. An exhaust gas recirculation control assembly for an engine having a induction passage for induction air flow and a recirculation passage for exhaust gas recirculation to said induction passage, said assembly comprising an orifice dividing said recirculation passage into a control pressure zone and a backpressure zone upstream of said control pressure zone, means defining a reference pressure chamber, a duty cycle operated valve for connecting said chamber to said backpressure zone during a portion of the duty cycle and to another zone during the remainder of the duty cycle to create a reference pressure in said chamber, a valve for regulating an operating pressure in response to a deviation of the pressure in said control pressure zone from a selected proportion of said reference pressure, and a control valve in said recirculation passage positioned in accordance with said operating pressure to provide exhaust gas recirculation at rates which maintain the pressure in said control pressure zone proportional to said reference pressure, whereby exhaust gas recirculation is provided as a proportion of induction air flow with said proportion being established by the duty cycle.

6. An exhaust gas recirculation control assembly for an engine having an induction passage for induction air flow and a recirculation passage for exhaust gas recirculation to said induction passage, said assembly comprising an orifice dividing said recirculation passage into a control pressure zone and a backpressure zone upstream of said control pressure zone, an operating diaphragm defining a portion of an operating pressure chamber, said chamber having an aperture for sensing a subatmospheric pressure signal and also having an air bleed and combining the pressures sensed through said aperture and said bleed to form an operating pressure, a control valve in said recirculation passage and positioned by said diaphragm to define an exhaust gas recirculation area in inverse relation to said operating pressure, a diaphragm assembly including a control diaphragm face defining a portion of a control pressure chamber connected to sense the pressure in said control pressure zone, said diphragm assembly further including a reference diaphragm face defining a portion of a reference pressure chamber having a port for sensing the pressure in said backpressure zone and another port for sensing the pressure in another zone, a valve for modulating at least one of said ports to create a reference pressure in said reference pressure chamber, and a bleed valve positioned by said diaphragm assembly to obstruct flow through said bleed when the pressure in said control pressure chamber exceeds a selected proportion of said reference pressure, whereby said control valve may be positioned to provide exhaust gas recirculation at rates which maintain the pressure in said control pressure zone proportional to said reference pressure and thus provide exhaust gas recirculation as a proportion of induction air flow with said proportion being established by said modulating valve.

7. An exhaust gas recirculation control assembly for an engine having an induction passage for induction air flow and a recirculation passage for exhaust gas recirculation to said induction passage, said assembly comprising an orifice dividing said recirculation passage into a control pressure zone and a backpressure zone upstream of said control pressure zone, a diaphragm defining a portion of an operating pressure chamber, said chamber having an aperture for sensing a subatmospheric pressure signal and also having an air bleed and combining the pressures sensed through said aperture and said bleed to form an operating pressuure, a control valve in said recirculation passage downstream of said pressure zones and positioned by said diaphragm to define an exhaust gas recirculation area in inverse relation to said operating pressure, a diaphragm assembly including a control diaphragm face defining a portion of a control pressure chamber connected to sense the pressure in said control pressure zone, said diaphragm assembly further including a reference diaphragm face defining a portion of a reference pressure chamber, a duty cycle operated valve connecting said reference pressure chamber to said backpressure zone during a portion of the duty cycle and to an atmospheric pressure zone during the remainder of the duty cycle to create a reference pressure in said reference pressure chamber, and a bleed valve positioned by said diaphragm assembly to obstruct flow through said bleed when the pressure in said control pressure chamber exceeds said reference pressure, whereby said control valve is positioned to provide exhaust gas recirculation at rates which maintain the pressure in said control pressure zone equal to said reference pressure and thus provide exhaust gas recirculation as a proportion of induction air flow with said proportion being established by the duty cycle.

8. The method of controlling exhaust gas recirculation in an engine having an induction passage for induction air flow, a recirculation passage for exhaust gas recirculation to said induction passage, an orifice dividing said recirculation passage into a control pressure zone and a backpressure zone upstream of said control pressure zone, and a control valve in said recirculation passage, said method comprising the steps of:

creating a reference pressure directly proportional to the backpressure in said backpressure zone, and operating said valve to provide exhaust gas recirculation at rates which maintain the pressure in said control pressure zone proportional to said reference pressure and thus provide exhaust gas recirculation as a proportion of induction air flow with said proportion being independent of induction air flow.

9. The method of controlling exhaust gas recirculation in an engine having an induction passage for induction air flow, a recirculation passage for exhaust gas recirculation to said induction passage, an orifice dividing said recirculation passage into a control pressure zone and a backpressure zone upstream of said control pressure zone, and a control valve in said recirculation passage, said method comprising the steps of:

providing a port between a reference pressure chamber and said backpressure zone and a port between said chamber and another zone, modulating at least one of said ports to create a reference pressure in said chamber, and operating said valve to provide exhaust gas recirculation at rates which maintain the pressure in said control pressure zone proportional to said reference pressure and thus provide exhaust gas recirculation as a proportion of induction air flow with said proportion being established by the modulation of said ports.

10. The method of controlling exhaust gas recirculation in an engine having an induction passage for induction air flow, a recirculation passage for exhaust gas recirculation to said induction passage, an orifice dividing said recirculation passage into a control pressure zone and a backpressure zone upstream of said control pressure zone, and a control valve in said recirculation passage, said method comprising the steps of:

creating a reference pressure in a reference pressure chamber by opening a port between said chamber and said backpressure zone during a portion of a duty cycle and by opening a port between said chamber and another zone during the remainder of the duty cycle, and operating said valve to provide exhaust gas recirculation at rates which maintain the pressure in said control pressure zone proportional to said reference pressure and thus provide exhaust gas recirculation as a proportion of induction air flow with said proportion being established by the duty cycle.

* * * * *